United States Patent [19]

Dubar et al.

[11] 4,441,711

[45] Apr. 10, 1984

[54] WRIST AND RING FINGER SUPPORT FOR BOWLER

[76] Inventors: Kenneth W. Dubar, 36 Northfield Rd., Wallingford, Conn. 06492; Armadio J. Onofrio, 44 Woodland Ave., North Haven, Conn. 06473

[21] Appl. No.: 420,269

[22] Filed: Sep. 20, 1982

[51] Int. Cl.[3] ..... A63B 69/00

[52] U.S. Cl. ..... 273/54 B; 2/161 A

[58] Field of Search ..... 273/54 B, 54 BA, 189 A; 2/161 A

[56] References Cited

U.S. PATENT DOCUMENTS

| | | | |
|---|---|---|---|
| 3,235,258 | 2/1966 | Stroburg | 273/54 B |
| 3,344,436 | 10/1967 | Stubbs | 273/54 B X |
| 3,467,379 | 9/1969 | Kistner | 273/54 B |
| 4,138,108 | 2/1979 | Robinson | 273/189 A X |
| 4,198,709 | 4/1980 | Clayton | 273/54 B X |
| 4,228,548 | 10/1980 | Cohen | 2/161 A |
| 4,371,163 | 2/1983 | Shaffer et al. | 273/54 B |

*Primary Examiner*—William H. Grieb

*Attorney, Agent, or Firm*—Delio and Libert

[57] ABSTRACT

A wrist and ring finger support for bowlers comprising a flexible glove element in combination with a rigid support piece, the glove element having straps for attachment to a bowler's hand and wrist and pocket for receiving a straight flat portion of the support piece in a position to support the wrist, the support piece having an extension at its distal end angled and shaped to provide effective support to the ring finger, as far as, and beyond the first joint. Each element is suitably padded, for the user's comfort.

4 Claims, 9 Drawing Figures

WRIST AND RING FINGER SUPPORT FOR BOWLER

This invention relates to a wrist and finger support for bowlers and more particularly to a so-called "glove" which comprises a relatively rigid support piece, having a novel configuration, in combination with a glove-like element for holding the support piece accurately in position on the bowlers' hand.

BACKGROUND OF THE INVENTION

The sport of bowling is widely enjoyed by persons of all ages and widely varying physical capabilities. Since successful bowling depends very largely on the strength and control of the bowler's arm and hand, particularly the fingers, numerous types of bowlers' gloves have been developed; this widespread use confirms the prevalence of a belief in their utility and effectiveness. While much attention has been given to the positioning and reinforcement of the wrist, it appears that less provision has been made for the support of specific fingers. Exceptions, in the patent literature, are Kistner U.S. Pat. No. 3,467,379 which provides support out to the middle joint of the middle and ring fingers (together), and Clayton U.S. Pat. No. 4,198,709 which provides a backing for the index finger.

The modern trend toward use of a finger-tip grip gives increased importance to the matter of finger support, particularly support for the ring finger which, in a proper ball delivering motion, is the last to leave the ball.

SUMMARY OF THE INVENTION

The wrist and finger support, referred to generally as a "glove" comprises a glove-like portion which may be of a suitable strong fabric such as vinyl with a pad of latex foam for comfort and three straps with fastening means to hold the glove in place on the bowler's hand. The second element in the combination is a substantially rigid (metal or plastic) support piece inserted in a pocket of the glove-like portion and shaped to provide both wrist support and backing for the ring finger, leaving only the finger tip free to engage in the appropriate hole in the ball.

OBJECTS OF THE INVENTION

It is an object of the invention to provide a bowler's glove which gives a measure of support for the wrist and ring finger.

It is a further object of the invention to provide a ring finger support which is unusually effective in enabling the bowler to obtain a stronger lift, causing more revolutions of the ball and better pin action.

It is another object of the invention to provide a bowlers' glove which is of simple construction, light weight, comfortable and easy to put on and remove.

It is still further object of the invention to provide a two-element device, each part of which can be made in a range of sizes to fit hands which may not be accommodated within the inherent range of adjustability of the standard right-handed or left-handed glove.

It is yet another object of the invention to provide certain improvements in the form, construction, arrangement and materials of the glove by which the above-named and other objects may effectively be attained.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

A practical embodiment of the invention is shown in the accompanying drawings, wherein.

Figure 1:
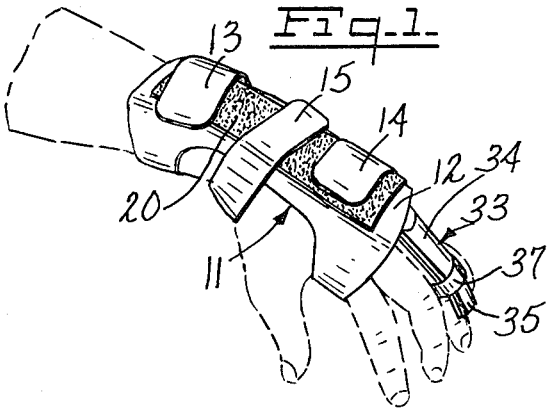
FIG. 1 represents a perspective view of the glove as worn by a left-handed bowler, viewed from the thumb side, the hand being in broken lines.

Referring to the drawings, the glove-like component 11 comprises a generally rectangular body portion 12 having straps 13,14 projecting laterally in one direction from points adjacent each end of the body and a third strap 15 projecting laterally in the opposite direction from a point substantially in the middle of the body but slightly closer to the end which will overlie the knuckles. The body portion 12 and straps 13,14,15 are made of strong durable fabric material, woven or sheet, such as vinyl. On its surface which will be considered the under side, the body 12 is provided with a rectangular pocket 16, extending almost to each opposite edge of the body, securely stitched and/or cemented along three of its edges and open at one of its ends such as the end 17 in FIG. 4.

Figure 4:
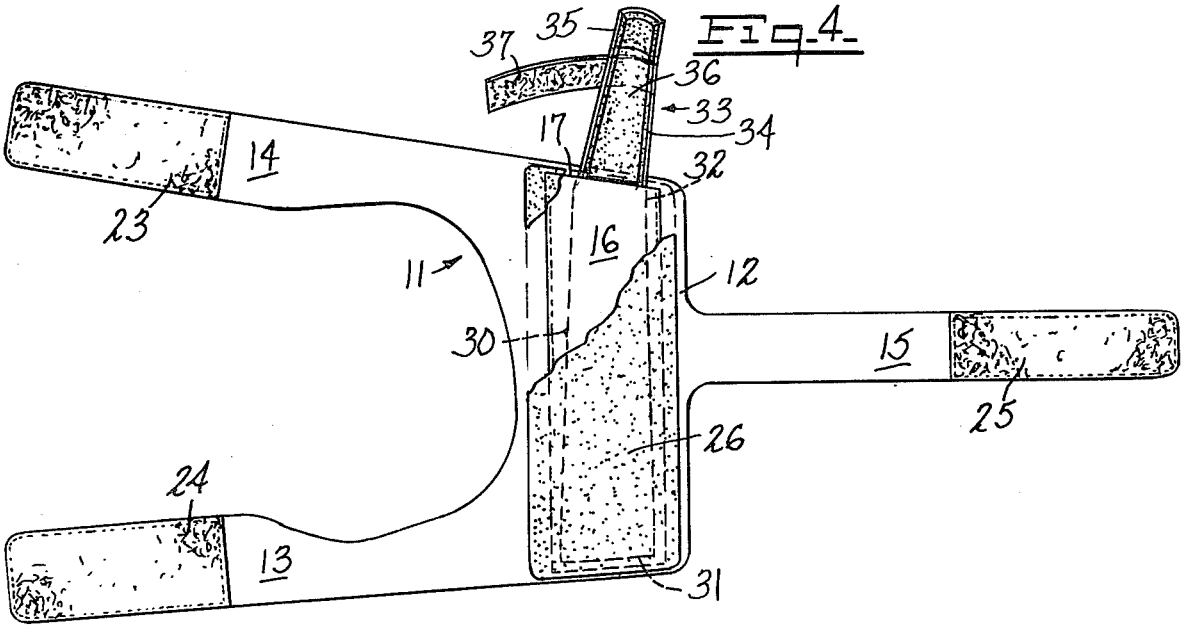
FIG. 4 represents a bottom plan view of the glove shown in FIG. 3.

The body surface which may be considered the upper side is provided with a rectangular patch 20 of adherent material which could be a peelable adhesive but is preferably a fish-hook surfaced pile fabric of the type known by the name "Velcro". Each of the straps 13,14,15 is provided, on its under side adjacent the strap end, with a corresponding patch 23,24,25, respectively, of adherent material adapted for releasable engagement with the patch 20, as will be explained below. The patches 20,23,24,25, whatever their nature, are firmly secured to the body and strap material, as by cementing. A pad of latex foam or the like 26 lines the body portion 12 throughout most of the area which might come in contact with the skin of the hand and overlies the pocket 16, as shown in FIG. 4.

The support piece, shown in detail in FIGS. 5 to 8, comprises a flat (planar), elongated body 30, tapering slightly from a maximum width at the free end 31 to a narrower size at the point 32 where it merges smoothly with the finger supporting extension 33. The first portion 34 of this extension is substantially straight and extends at an angle from 10° to 25°, preferably about 20° (downward in FIG. 1) from the plane of the body 30. The second (tip) portion 35 of the extension is further bent in the same direction to lie at an angle from 35° to 55°, preferably about 45° to the plane of the body 30. Dimensionally, the body 30 has a length sufficient to extend from the knuckles to a point just past the wrist joint, i.e., normally about 6". The first portion 34 of the extension has a length corresponding to the average length of a ring finger, from knuckle to first joint, which may be about 2", and the second portion 35 has about half that length.

Figure 5:
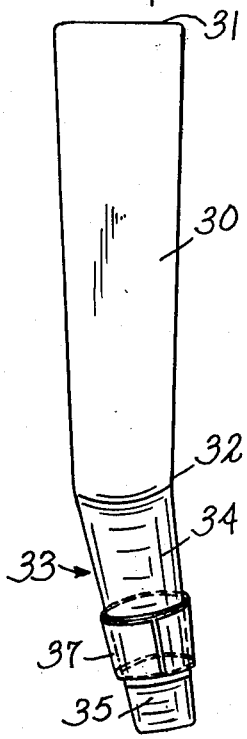
FIG. 5 represents a top plan view of the support piece alone.
Figure 6:
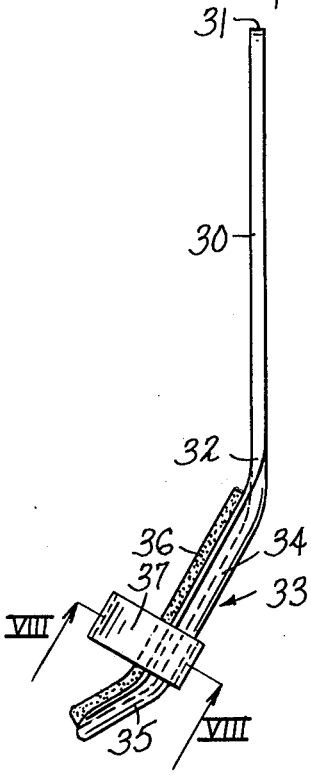
FIG. 6 represents a side elevation of the support piece.
Figure 7:
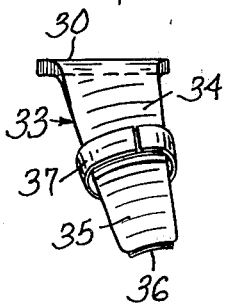
FIG. 7 represents an end elevation of the support piece, viewed from the finger-support end.
Figure 8:
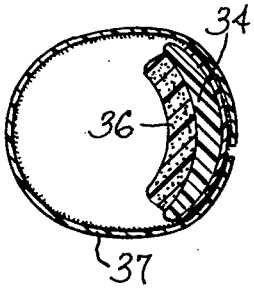
FIG. 8 represents a section on the line VIII—VIII of FIG. 6.
Figure 9:
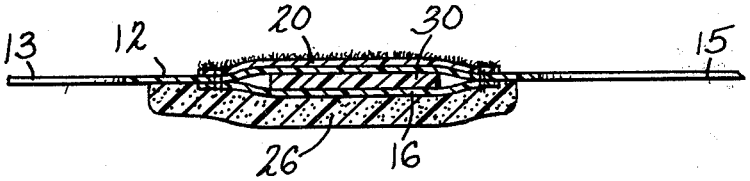
FIG. 9 represents a section on the line IX—IX of FIG. 3.

Since the ring finger, in engaging the hole in a bowling ball, is angled slightly outward—away from what may be considered the central longitudinal axis of the hand and arm—the extension 33 is correspondingly angled slightly toward the right or left, according to the handedness of the bowler, as shown in FIGS. 5 and 7. The extension is also given an arcuate cross-sectional form, to constitute a shallow channel, and is provided, on its concave side, with a lining 36 of latex foam or the like for improved finger comfort. A fastening band 37 of "Velcro" type material or the like is provided near the distal end of the extension portion 34 to hold the ring finger reliably in place against the lining 36 while leaving free the finger tip for engagement in the bowling ball hole.

Figure 2:
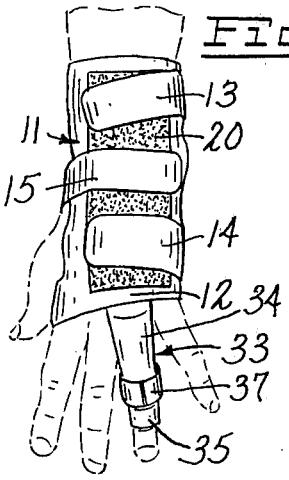
FIG. 2 represents a similar view looking toward the back of the hand.
Figure 3:
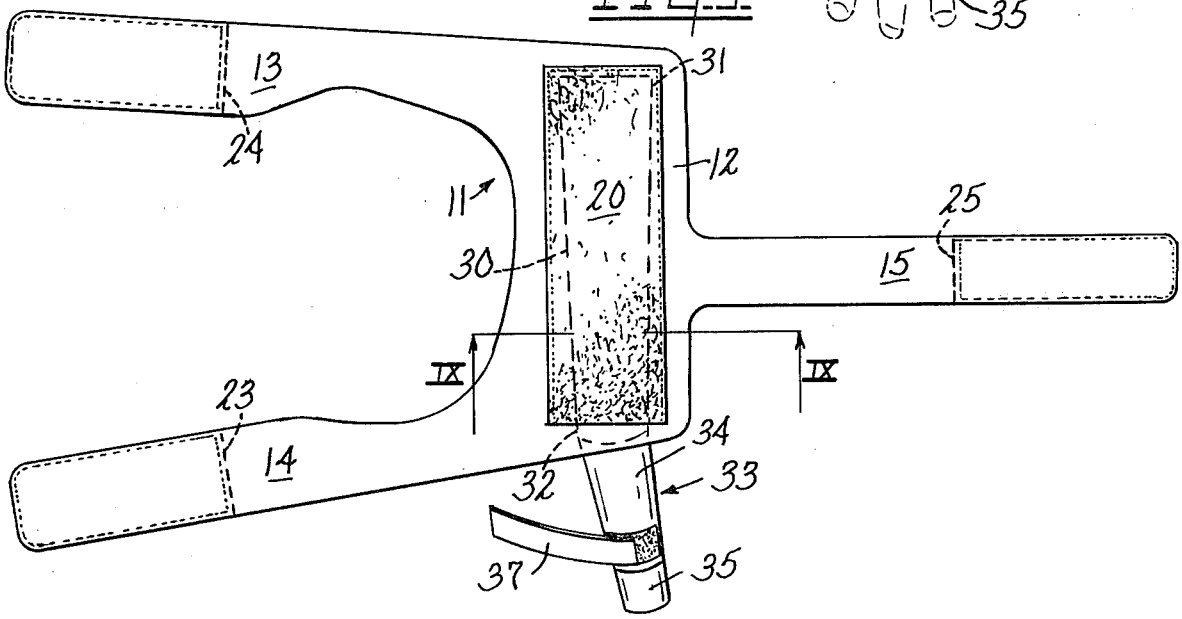
FIG. 3 represents a top plan view of the glove with all elements assembled and laid out as flat as possible.

The glove shown in the drawings described above is for a left-handed bowler as indicated in FIGS. 1 and 2. In use, the body portion 12 is placed on the back of the hand and wrist, the strap 13 is wrapped around the wrist with its free end pad 23 engaging the pad 20 and the strap 14 is wrapped around the hand, just in front of the thumb, with the pad 24 also engaging the pad 20. The securement is completed by passing the strap 15 around the heel of the hand and engaging its pad 25 centrally on the pad 20. The placement of the glove and support combination should bring the extension 33 over the ring finger where it is held by means of the fastening band 37.

The support piece as a whole serves two functions. The body 30 is constructed of metal or a strong plastic material, for rigidity, particularly as a wrist support. It aids in ensuring the maintenance of a consistent wrist position, which is very important to the proper release of a bowling ball. The principal purpose of the extension 33 is to provide mechanical support for the ring finger which is the last finger out of a bowling ball on the release. The extension is angled from the body of the support piece at about the knuckle line in order to provide a comfortable fit of the finger against the padded channel-shaped extension where the back of the finger rests very comfortably. The fastening band 37 wraps around the ring finger, to retain the finger and extension in proper relationship while leaving the finger tip free to engage in the ball. The angling of the tip portion 35 is important in giving added support to the ring finger up to the joint close to the finger tip, thus putting the ring finger in ready position for the lift which takes place at the instant of ball release.

By supporting the ring finger as just described, the glove requires the bowler, upon release, to lift the fingers from under the ball with a rotating motion. The ring finger, being the last one out, creates the most power. The glove and support piece described herein automatically provide stronger lift resulting in less deflection with more revolutions on the ball, thus creating more pin action.

It will thus be seen that the objects set forth above, among those made apparent from the preceding description, are efficiently attained and, since certain changes may be made in carrying out the above method (process) without departing from the spirit and scope of the invention, it is intended that all matter contained in the above description shall be interpreted as illustrative and not in a limiting sense.

What I claim is:

1. A wrist and finger support for bowlers comprising, in combination, a glove-like element and a rigid support piece, the glove-like element being of flexible fabric shaped to include, a rectangular body portion having a length sufficient to extend from the user's knuckles to a point proximally beyond the wrist, a first elongated strap element integral with the body portion and extending from a point along a first edge of said portion which is adjacent one end of said portion, laterally in a direction substantially normal to the long dimension of the body portion.

a second elongated strap element integral with the body portion and extending from a point along said first edge which is adjacent the other end of said portion laterally in a direction substantially parallel to that of said first strap, a third elongated strap element integral with the body portion and extending from a point along a second edge of said portion which point is spaced from each end of said portion, each of said straps having a body portion end and a free end, an area of releasably adherent material mounted on one surface of said body portion, areas of releasably adherent material adjacent the free ends of each strap on a surface adapted to cooperate with the area of adherent material on the body portion, an elongated pocket element fixed to the body element longitudinally thereof and having an open end adjacent the knuckle end of said body element, and the support piece being of substantially rigid material shaped to include, a substantially rectangular elongated planar body portion, a finger supporting extension integral with the support body portion at one end thereof and angled both out of the plane of said portion in the direction toward the user's fingers and away from the longitudinal axis of the support body portion toward the user's ring finger, said extension being arcuate in transverse cross-section and provided with padding on its concave surface.

2. A wrist and finger support according to claim 1 wherein the extension is so located as to lie along the back of the user's ring finger.

3. A wrist and finger support according to claim 2 wherein the finger support extension is further angled out of the plane of support body portion in the same direction at a point so located as to lie substantially opposite the first joint of the ring finger.

4. A wrist and finger support according to claim 2 which includes an inextensible flexible band adapted to hold the user's ring finger firmly against the extension padding.

* * * * *